US005839388A

United States Patent [19]

Vadney

[11] Patent Number: 5,839,388

[45] Date of Patent: Nov. 24, 1998

[54] CLIP ASSEMBLY

[75] Inventor: Michael W. Vadney, Auburn, Ind.

[73] Assignee: N.A. Taylor Company, Inc., Gloversville, N.Y.

[21] Appl. No.: 881,758

[22] Filed: Jun. 24, 1997

[51] Int. Cl.[6] ..... B63B 17/00

[52] U.S. Cl. ..... 114/361; 411/913

[58] Field of Search ..... 411/182, 337, 411/340, 345, 346, 354, 360, 366, 385, 427, 432, 508, 913; 114/361

[56] References Cited

U.S. PATENT DOCUMENTS

| | | | |
|---|---|---|---|
| 3,141,489 | 7/1964 | Rapata | 411/913 |
| 3,304,657 | 2/1967 | Singleton . | |
| 3,843,982 | 10/1974 | Lane et al. . | |
| 3,869,958 | 3/1975 | Murayama | 411/913 |
| 4,657,458 | 4/1987 | Woller et al. | 411/182 |
| 4,729,704 | 3/1988 | Yokoyama | 411/61 |
| 5,339,763 | 8/1994 | Erskine . | |

OTHER PUBLICATIONS

Photograph of prior art mounting assemblies discussed in the specification.

*Primary Examiner*—Stephen Avila
*Attorney, Agent, or Firm*—Nixon & Vanderhye P.C.

[57] ABSTRACT

A clip assembly is provided for fastening a boat top to a boat windshield frame which avoids corrosion, is simple and easy to properly locate and install, has long life, and is inexpensive to make. The aluminum extrusion frame for the boat windshield has an elongated channel with an open side with lips defining the open side. An integral piece of plastic anchor fits within the channel, with grooves receiving the lips, and a disc-shaped end engaging the extrusion exteriorly of the channel. A metal fastener having a screw threaded shank and a snap fastener head is screwed into the anchor, causing it to be biased into intimate contact with the channel so that the fastener head will not move once properly positioned and the fastener shank tightened. Cooperating fasteners on the boat top are then snapped into engagement with the anchored fastener head.

20 Claims, 5 Drawing Sheets

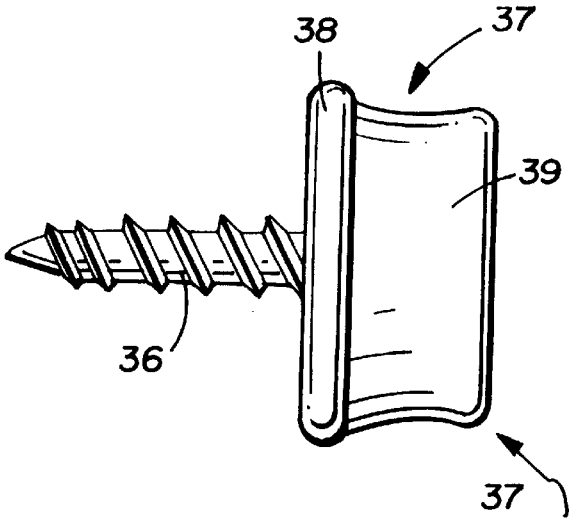
Fig. 3
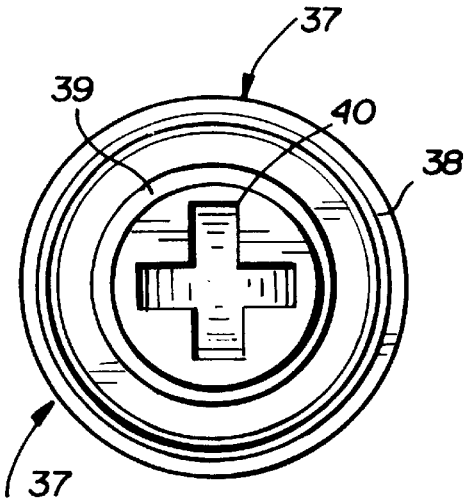
Fig. 4
Fig. 6
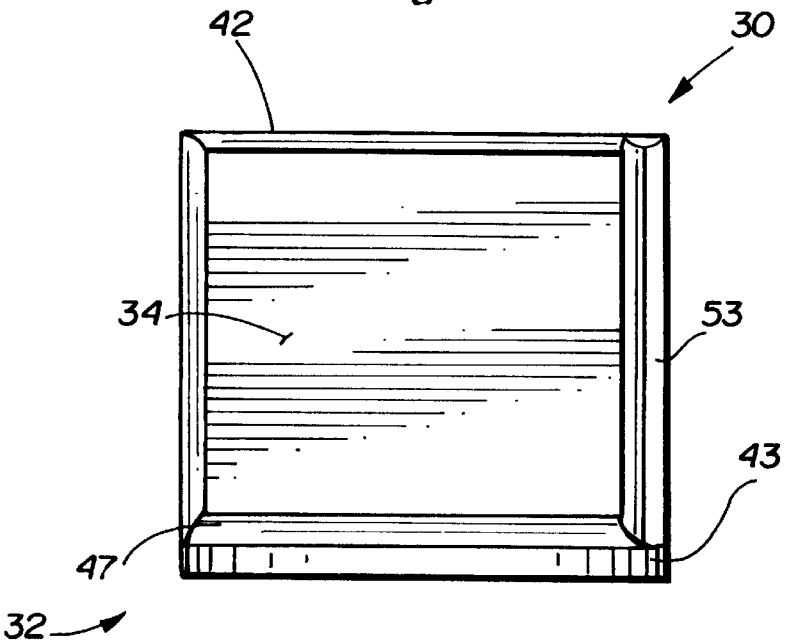

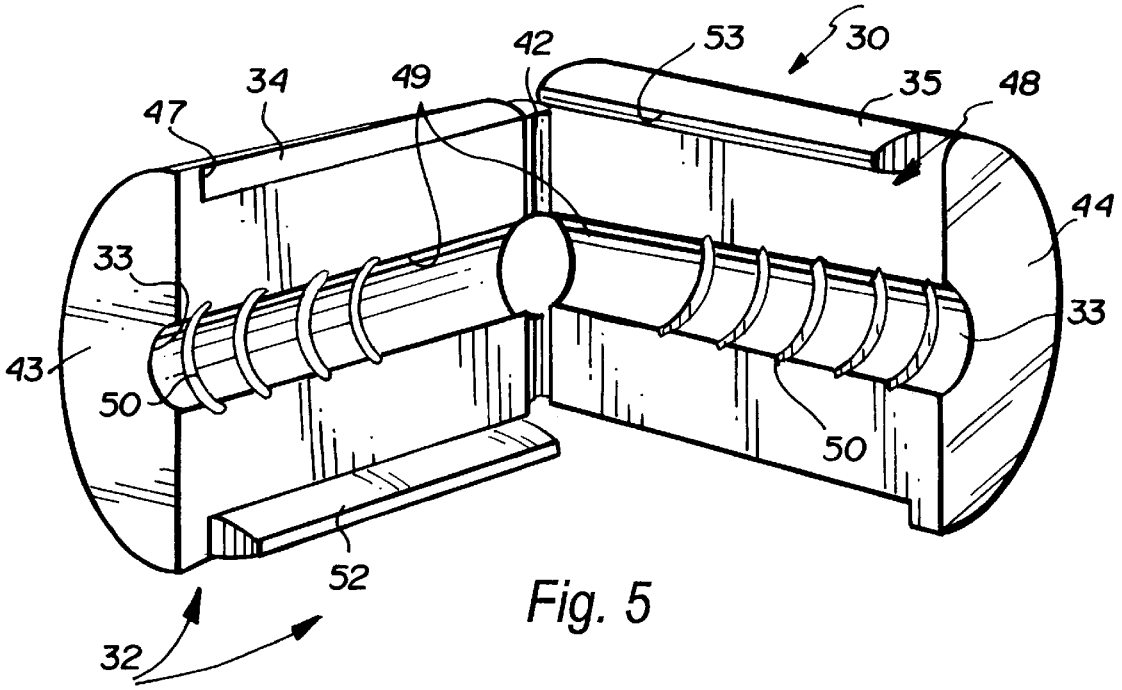
Fig. 5
Fig. 7
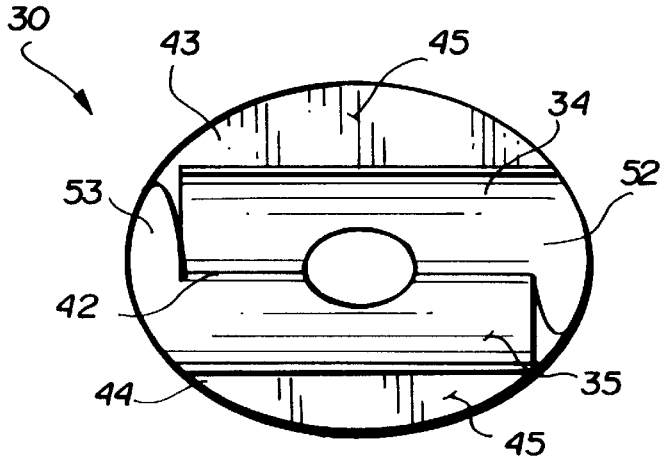

CLIP ASSEMBLY

BACKGROUND AND SUMMARY OF THE INVENTION

The most common way of releasably attaching a boat top (typically of canvas, reinforced plastic, or like cloth-like materials) onto a boat is to use a number of snap fasteners that are positioned on the boat windshield frame and cooperate with corresponding fasteners on the boat top. The proper mounting of the fasteners on the windshield frame (which commonly is an aluminum extrusion) can cause a number of practical difficulties, however. There are a wide variety of conventional techniques for doing that, all of which have drawbacks.

One conventional technique for mounting fasteners on a boat windshield frame is to drill holes in the frame corresponding to the positions where the fasteners are to be located, and then to position the fasteners in the holes. A wide variety of different types of fasteners may be positioned in such holes, such as nylon screws having female snap fastener heads, nylon snap fastener heads with split integral shanks which shanks are expanded to frictionally engage the opening by forcing a central nylon pin through a central opening of the snap fastener to expand the shank into place, metal snap fasteners with integral metal shanks, hollow metal snap fasteners, which are pop riveted into place, and the like. Another alternative, where the aluminum extrusion comprising the frame has a channel formed therein, is to utilize a metal clip integral with the snap fastener head, the metal clip having one bent end which clips onto the bottom of the extrusion between the extrusion and the windshield pane received by the extrusion, and an opposite end which clips onto a lip in the channel; or a plastic snap fastener head may be integral with an angled mounting portion which is somehow wedged between the pane and the extrusion, or otherwise provided in particularly configured openings in the extrusion.

Most of the prior art mechanisms described above have significant disadvantages. For example the use of drilled holes is highly disadvantageous because it requires a great deal of time to install the fasteners, and if the holes are not properly positioned then the boat top will not fit into place properly, if holes are improperly drilled the frame becomes unaesthetic, and if steel snap fasteners are used with the drilled holes in an aluminum frame there will be corrosion as a result of electrical forces that are established between the dissimilar metals. Similarly with metal clips that fit in extrusion channels, because of the dissimilarity between the metals corrosion can easily occur in a marine environment. Plastic clips are not of suitable longevity and may be difficult to properly position.

According to the present invention a mounting assembly for a boat top, and an expanding fastener assembly per se, are provided which overcome the drawbacks associated with the prior art as discussed above. The mounting assembly for a boat top according to the present invention is simple and easy to use, has all of the benefits of a metal snap fastener head without the realistic possibility of corrosion due to electrical forces being set up between the aluminum extrusion and the metal of the snap fastener, yet the snap fasteners are easy to position without drilling holes, can be anchored positively in place, yet can be adjustable to accommodate different boat tops or change positions of fasteners due to shrinkage or other changes in the boat tops. The components of the invention are also simple and inexpensive to manufacture. Therefore the mounting assembly, and expanding fastener assembly per se, according to the present invention are extremely easy to use and adjust yet can be positively positioned, positively holding a boat tops in place, and have long life.

According to one aspect of the present invention, an expanding fastener assembly is provided. The fastener assembly comprises the following components: An anchor comprising an integral piece of plastic (e.g. nylon) having a central pivot, and pivotal about the pivot to define top and bottom portions and a front end. The top and bottom portions having substantially planar exterior portions that are generally quadrate in plan, and an interior face. The front end comprises first and second elements cooperating to form a substantially disc shaped end with a central opening. And, an anchor expanding fastener comprising a shank and a head, the shank dimensioned and configured to fit within the central opening to bias the top and bottom portions away from each other when the shank is received within the opening.

The assembly further comprises a groove formed in each of the top and bottom portions adjacent the first and second elements, respectively, the grooves for receiving lips (e.g. of a boat frame extrusion) for positioning the anchor. Preferably the shank has exterior screw threads and the interior faces of the top and bottom portions have interior screw threads which are formed when the shank is first screwed into the anchor. The fastener is preferably metal (e.g. stainless steel) and the head includes a driving tool-receiving configuration to facilitate rotation of the fastener by a screwdriver, Allen wrench, or like driving tool. For example the head may comprise a snap fastener (male or female, preferably male) with a screwdriver-receiving configuration formed centrally of the snap fastener. The pivot preferably comprises a living hinge, and the anchor may be easily injection molded from plastic.

According to another aspect of the present invention a mounting assembly for a boat top is provided comprising the following components: A frame for a boat windshield, the frame having an elongated channel with a first, open side, a second, closed side opposite the first side, and third and fourth closed sides extending between the first and second sides, and a lip at the intersection of each of the third and fourth sides with the first side, the channel having generally a trapezoidal configuration in cross section. An expandable anchor disposed in the channel, and having a cross-sectional configuration and dimensions so that the anchor fits in the channel. And, an anchor-expanding fastener comprising a shank which is received by the expandable anchor and which expands the anchor when moved with respect to the anchor, and a snap fastener head, the shank extending into the channel from the first side thereof, and the snap fastener head disposed exteriorly of the channel for receipt of a snap fastener head of a boat top.

The expandable anchor preferably comprises a front end with an expanding fastener shank-receiving opening therein, a rear end comprising a pivot, and top and bottom faces dimensioned and configured to frictionally engage the third and fourth sides of the channel. The front end of the anchor preferably has a disc-shaped configuration with an exterior face and an interior face, the interior face engaging the frame adjacent the channel at the first side, and the anchor further including a groove adjacent the disc interior face formed in each of the top and bottom faces, the grooves receiving the channel lips therein. Preferably the anchor comprises an integral piece of plastic (such as nylon) having the pivot formed centrally thereof (e.g. in the form of a living hinge), and foldable about the pivot so as to form the disc-shaped front end and top and bottom faces. Typically the anchor front face is two piece, having one piece integral with each of the top and bottom faces. The top and bottom faces also preferably include overlapping side edges for guiding relative movement between those faces and to obscure the view of the threads for enhanced aesthetics.

The frame containing the channel typically comprises an aluminum extrusion, and the fastener typically comprises stainless steel, the anchor separating all portions of the fastener from the extrusion so that the extrusion and fastener do not engage each other (and therefore electrical currents which cause corrosion are not set up). Preferably the fastener shank is screw threaded and the disc-shaped front end of the anchor comprises a circular opening for receipt of the screw threaded shank, rotation of the shank expanding the anchor into tight engagement with the frame so that the anchor will not move with respect to the frame. The anchor expanding fastener head may comprise either a male or female snap fastener, but preferably comprises a male snap fastener for cooperation with a female snap fastener of a boat top. The anchor typically includes a central opening for receiving the fastener, the central opening including internal screw threads formed when the shank is first screwed into place, and a driving tool engageable configuration is formed centrally of the fastener head to facilitate rotation by a screwdriver or the like.

Typically a plurality of the anchors, and associated anchor expanding fasteners, are provided spaced from each other in the channel, and the assembly is in combination with a boat top and having snap fasteners spaced to conform to the spacings of the anchor expanding fasteners, the boat top fasteners engaging the anchor-expanding fasteners to releasably hold the boat top to the boat windshield frame. The snap fasteners of the anchor and the boat top may comprise any conventional type of snap fastener. The snap fasteners may be substantially the only components holding the boat top onto the frame. Alternatively, the anchors and associated snap fasteners may be more widely spaced merely to provide location anchors while the connection between the frame and the snap fasteners is more extensive. This is typically provided by utilizing a boat top having a plastic (e.g. vinyl) anchoring fringe configured and dimensioned to fit within the channel and assist in holding the boat top in the channel.

It is the primary object of the present invention to provide a mounting assembly for a boat top, and an expanding fastener assembly per se, which are simple and easy to use, have long life, are inexpensive to make, and positively fasten a boat top in place. This and other objects of the invention will become clear from an inspection of the detailed description of the invention and from the appended claims.

BRIEF DESCRIPTION OF THE DRAWINGS

FIG. 3 is a side view of an exemplary configuration of an anchor-expanding fastener per se according to the invention;

FIG. 4 is a front view of the fastener of FIG. 3;

FIG. 5 is a perspective view of an exemplary expandable anchor according to the present invention for use in the assembly of FIGS. 1 and 2 and with the fastener of FIGS. 3 and 4, the anchor shown in an open position;

FIG. 6 is a top view of the anchor of FIG. 5 when the components are pivoted together to an operable configuration;

FIG. 7 is a rear view of the anchor of FIGS. 5 and 6 with the fastener of FIGS. 3 and 4 disposed therein.

DETAILED DESCRIPTION OF THE DRAWINGS

Figure 1:
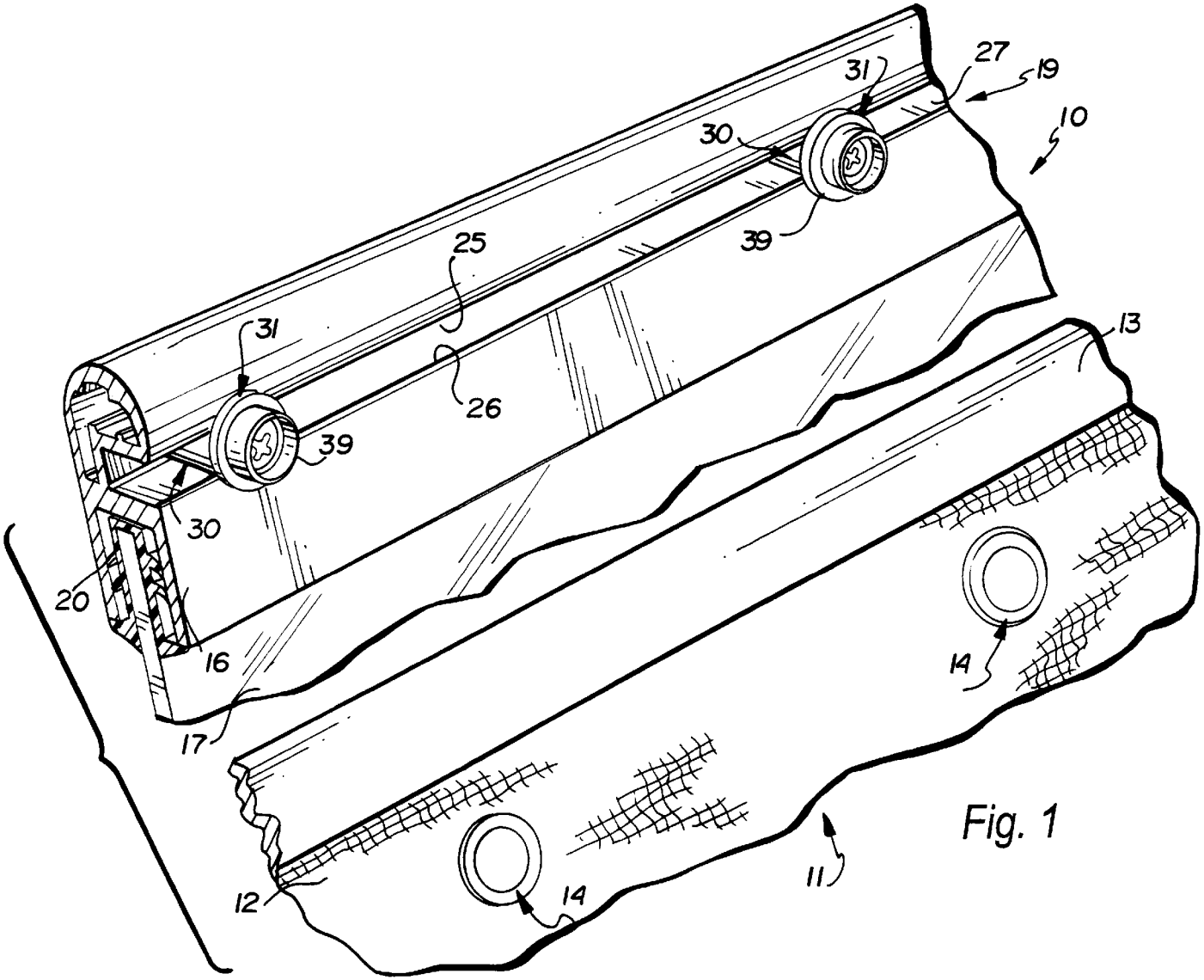
FIG. 1 is a perspective detail view showing a boat windshield with anchored fasteners according to the invention and a boat top with aligned fasteners that may be used therewith.
Figure 2:
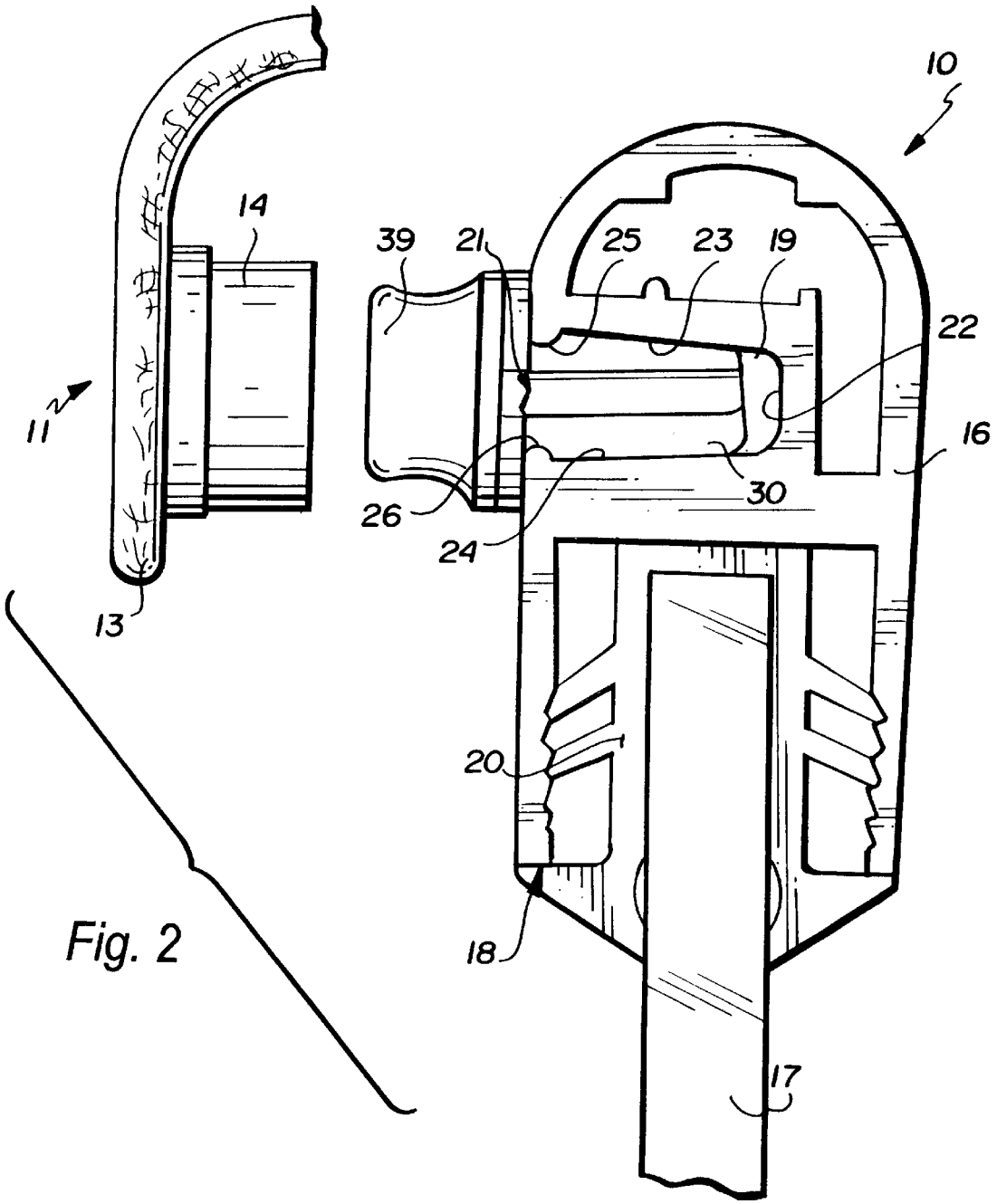
FIG. 2 is a side view of the components of FIG. 1.

FIGS. 1 and 2 illustrating a mounting assembly, shown generally by reference numeral 10, for a boat top, shown generally by reference numeral 11, according to the present invention. The boat top 11 illustrated in FIGS. 1 and 2 typically comprises a body of cloth 12, such as canvas, or a reinforced plastic or like material having cloth-like properties. Along the exterior edge 13 of the cloth 12 is a hem or border and particularly spaced snap fasteners 14 are connected to the cloth 12 at (or preferably below—see FIG. 1) the hem along edge 13 by any conventional technique. The snap fasteners 14 may comprise any conventional type of snap fastener of any suitable material, and may be male or female. In the preferred embodiment illustrated in the drawings the snap fasteners 14 are metal (e.g. stainless steel) female fasteners.

The mounting assembly 10 includes a frame 16 for a boat windshield 17. While only one portion of the frame 16 is illustrated in the drawings it is to be understood that the boat top 11 will typically cooperate with a number of different frame components, typically the front and sides of the windshield of the boat (see U.S. Pat. Nos. 3,304,657, 3,843,982 and 5,339,763). The frame 16 typically, though not necessarily, comprises an aluminum extrusion including one channel-shaped portion 18 (see FIG. 2) for receiving the windshield 17 of transparent material, and preferably comprising another elongated channel 19 generally transverse to the channel 18 and for receipt of snap fasteners for cooperating with the fasteners 14, as will be hereinafter described. The windshield 17 is typically mounted in channel 18 using a conventional vinyl extrusion 20.

As seen most clearly in FIG. 2, but also seen in FIG. 1, the channel 19 includes a first, open side 21, a second, closed, side 22 opposite the open side 21, and third and fourth closed sides (the top and bottom sides) extending between the first and second sides 21, 22. A lip 25, 26 is formed at the intersection of each of the third and fourth sides 23, 24 with the first side 21. As seen in FIG. 2 the channel 19 preferably has generally a trapezoidal configuration in cross-section. The channel 19 may have open ends, such as the end 27, so that components can be slid into the channel 19, but preferably the ends are closed, e.g. by conventional plastic caps or other constructions. The extrusion 16 with channel 19 per se is conventional, typically used with metal clip snap fasteners and/or boat tops having plastic anchoring fringe configured and dimensioned to fit within the channel 19, as will be explained with respect to the embodiment of FIG. 8.

According to the present invention the mounting assembly 10 according to the present invention includes entirely different fasteners anchored in an entirely different manner than the prior art, and having the advantages of corrosion resistance, long life, ease of use, and ease and inexpensiveness of construction, compared to conventional fastening systems. The fasteners associated with the mounting assembly 10 according to the present invention comprise an expandable anchor, shown generally by reference numeral 30 in FIGS. 1, 2, and 5 through 7, and an anchor expanding fastener shown generally by reference numeral 31 in FIGS. 1 through 4.

The expandable anchor 30 preferably is of plastic, such as nylon, or a material comparable to plastic that can physically and electrically isolate the fastener 31 from the extrusion 16 so that corrosion as a result of electrical current flowing as a result of dissimilarities between the aluminum of the extrusion 16 and the typically stainless steel construction of the fastener 31 is avoided. The expandable anchor 30 when disposed in the channel, as illustrated in FIG. 2, has a cross-sectional configuration and dimensions so that the anchor fits in the channel 19 securely, e.g. having a generally trapezoidal configuration and cross-section corresponding to the generally trapezoidal configuration of the channel 19.

The expandable anchor 30 includes a front end 32 with an expanding fastener shank-receiving opening 33 therein, and top and bottom faces 34, 35, respectively, dimensioned and configured to frictionally engage the third and fourth side 23, 24, respectively, of the channel 19.

The fastener 31 has a shank 36 and a head 37. The shank 36 preferably has exterior screw threads, although other projections or contours may be provided for cooperation with the anchor 30. The head 37 preferably comprises a disc 38 and a conventional snap fastener 39. While the snap fastener 39 may be any conventional snap fastener and it may be either male or female, in the preferred embodiment illustrated the snap fastener 39 is a male snap fastener. The head 37 also includes a driving tool-receiving configuration 40 located centrally of the snap fastener 39 (for any receiving type of screwdriver or other driving component, such as a flat bladed screwdriver, Phillips head screwdriver, Allen wrench, etc.) to facilitate rotation of the shank 36 into operative association with the anchor 30.

In the preferred embodiment of the anchor 30, best seen in FIGS. 5 through 7, it comprises an integral piece of plastic (nylon) including a pivot 42 at the rear end thereof when the anchor 30 is positioned within the channel 19 (the rear end pivot 42 adjacent the second side 22 of the channel 19), but centrally located when the anchor 30 is formed and before it is pivoted to the configuration which is slid into the channel 19. The pivot 42 preferably comprises a living hinge.

The front end 32 preferably has a generally disc-shaped configuration, so that the anchor front face 32 is two piece, having a first piece 43 integral with the top face 34 and a second piece 44 integral with the bottom face 35, the pieces 43, 44 together, when the anchor 30 is pivoted about the living hinge 42, substantially forming a disc. The disc includes a face 45 which actually engages the extrusion 16 at the area of the lips 25, 26 and—as illustrated in FIG. 2—positively physically and electrically separates the head 37 of the fastener 31 from the extrusion 16.

The exterior portions of the top and bottom faces 34, 35 typically frictionally engage the surfaces 23, 24 of the extrusion 16, and preferably grooves 47, 48 are formed therein immediately adjacent the disc-shaped elements 43, 44, the grooves 47, 48 receiving the lips 25, 26, respectively therein and positively positioning the anchor 30 in the channel 19.

The anchor 30 also preferably has interior portions of the top and bottom faces 34, 35 which combine to form a central opening 49 cooperating with the opening 33 and the front end 32 of the anchor 30 for receiving the shank 36 of the fastener 31 therein, the opening 49 preferably including internal screw threads 50 formed therein which cooperate with the external screw threads of the shank 36. The threads 50 may be pre-formed, but preferably the opening 49 is originally smooth and the threads 50 are formed in the plastic of the anchor 30 when the metal screw shank 36 is first screwed into place into the opening 49.

The anchor 30 also preferably has overlapping side edge portions 52, 53 of the top and bottom faces 34, 35, respectively, which guide relative movement between the faces 34, 35 so that the anchor 30 properly positions itself when expanded by the fastener 31, and obscures the view of the threads of fastener 31 for enhanced aesthetics.

In an exemplary use of the mounting assembly 10 with a boat top 11 according to the present invention, a plurality of anchors 30 are preferably inserted into the channel 19 through the open side 21, or may be passed through the open end 27 of the channel 19 so that the grooves 47, 48 thereof engage the lips 25, 26 of the channel 19, and then are slid to proper locations in the extrusion 19 corresponding to the spacings of the fasteners 14 on the boat top 11. Once a proper position is located for an anchor 30, an anchor expanding fastener 31 is moved into operative association therewith by placing the shank 36 through the opening 33 and then engaging the configuration 40 with a screwdriver, Allen wrench, or the like and rotating the fastener 31 so that the screw threads of the shank 36 engage the screw threads 50 of the anchor 30. The faces 34, 35 of the anchor 30 are biased away from each other by the fastener 31 and move into frictional engagement with the sides 23, 24 of the channel 19 and the grooves 47, 48 are biased into tight engagement with the lips 25, 26. Ultimately, when the fastener 31 is completely screwed into place, the disc 38 of the head 37 engages the generally disc configuration (formed by elements 43, 44) of the front end 32 of the anchor 30, and presses the elements 43, 44 into tight engagement with the extrusion 16 adjacent the lips 25, 26. Thus in this position the fastener 31 is completely physically and electrically isolated from the extrusion 16 by the plastic body of the anchor 30, and the anchor 30 is positively located in place so that it cannot be moved within the channel 19 unless the fastener 31 is unscrewed.

After all of the fasteners 31 and associated anchors 30 are properly positioned in the channel 19 then the fasteners 14 of the boat top 11 are snapped into engagement with the fasteners 39, properly positioning the boat top 11 in place with respect to the frame extrusion 16. This same procedure is repeated for all other extrusions 16 forming the frame of the windshield (typically being provided by at least a front windshield and two side windshield portions) so that the boat top 11 is properly anchored in place.

Figure 8:
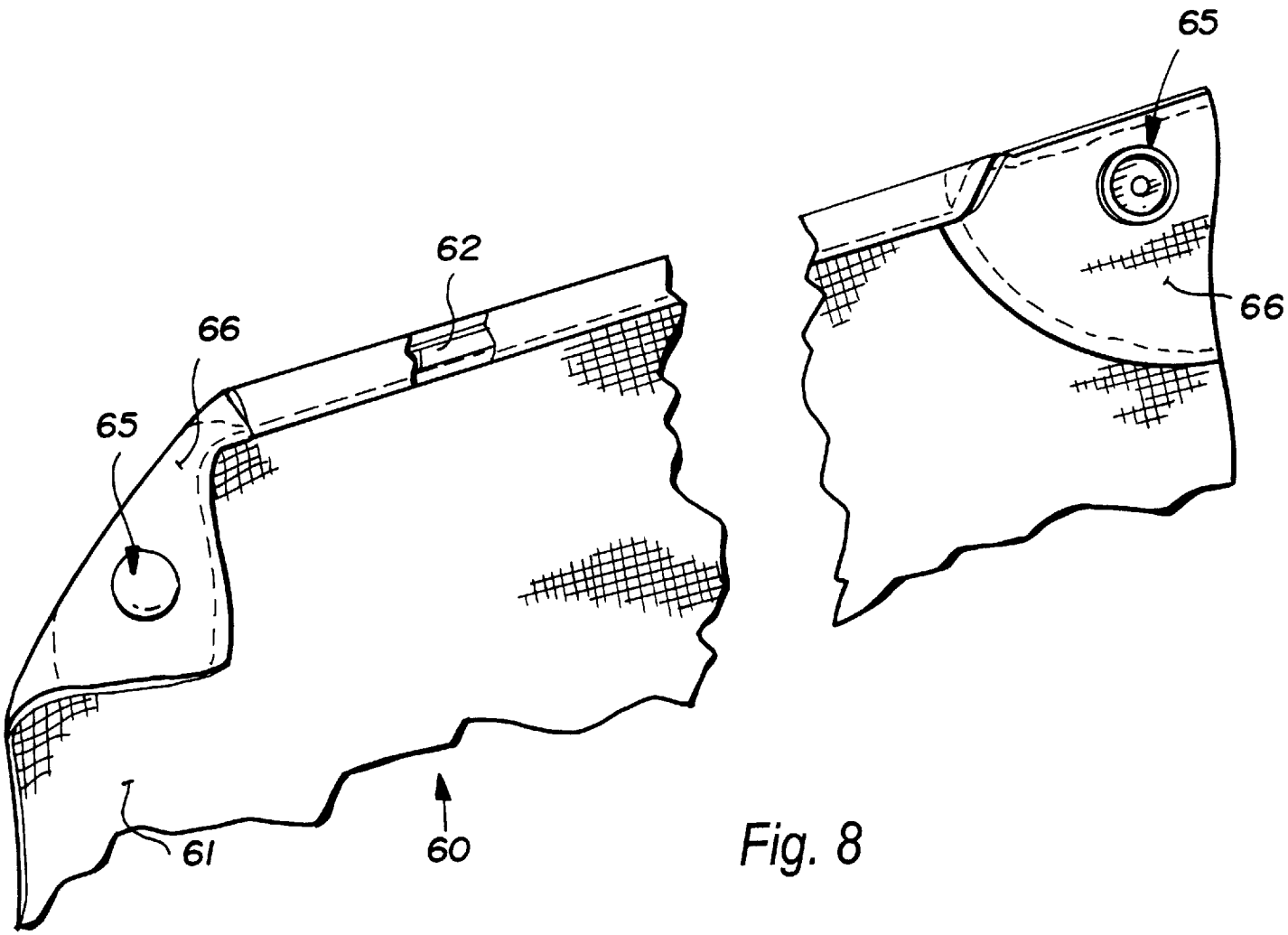
FIG. 8 is a perspective detail view of another form of boat top mounting assembly that could be utilized with the mounting assembly according to the present invention.

FIG. 8 illustrates another boat top, shown generally by reference numeral 60, which may be utilized with the mounting assembly 10 according to the invention. The boat top 60 comprises a cloth (e.g. canvas) or cloth-like body 61, but differs from the top 11 in that a plastic anchoring fringe 62 is secured to the body 60 e.g. enclosed in hem 63, or by rivets, or in any other conventional manner. The fringe 62, which typically comprises vinyl, is configured and dimensioned to fit within the channel 19 (along with the surrounding cloth of the hem 63). That is by sliding fringe 62 into the channel 19, either directly, or through an open end 27, the fringe 62 will position the boat top 60 in place.

While in conventional boat tops typically only the fringe 62 is utilized to mount the boat top in place, according to the present invention, the fasteners 31 and anchors 30 are provided (e.g. at widely spaced locations) in order to provide secure positioning. Conventional snap fasteners 65, like fasteners 14, may be provided on flap portions 66 of the cloth 61 to cooperate with fasteners like the fasteners 39 to hold top 60 in place.

Because of the simplicity of construction and use of the mounting assembly 10 according to the invention, the invention may be readily utilized with either boat tops like the boat top 11 or boat tops like the boat top 60, or any other common versions of boat tops, without requiring any different configuration of the mounting assembly 10 according to the invention.

It will thus be seen that according to the present invention a highly advantageous mounting assembly 10 for a boat top 11, 60, and a mounting assembly 10 in combination with a boat top 11, 60, have been provided, as well as an expanding fastener assembly 30, 31, per se. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mounting assembly for a boat top, comprising:

a frame for a boat windshield, said frame having an elongated channel with a first, open side, a second, closed side opposite said first side, and third and fourth closed sides extending between said first and second sides, and a lip at the intersection of each of said third and fourth sides with said first side, said channel having generally a trapezoidal configuration in cross section;

an expandable anchor disposed in said channel, and having a cross-sectional configuration and dimensions so that said anchor fits in said channel; and an anchor-expanding fastener comprising a shank which is received by said expandable anchor and which expands said anchor when moved with respect to said anchor, and a snap fastener head, said shank extending into said channel from said first side thereof, and said snap fastener head disposed exteriorly of said channel for receipt of a snap fastener head of a boat top.

2. An assembly as recited in claim 1 wherein said expandable anchor comprises a front end with an expanding fastener shank-receiving opening therein, a rear end comprising a pivot, and top and bottom faces dimensioned and configured to frictionally engage said third and fourth sides of said channel.

3. An assembly as recited in claim 2 wherein said front end of said anchor has a generally disc shaped configuration with an exterior face, and an interior face, said interior face engaging said frame adjacent said channel at said first side, and wherein said anchor further includes a groove adjacent said disc interior face formed in each of said top and bottom faces, said grooves receiving said lips therein.

4. An assembly as recited in claim 3 wherein said anchor comprises an integral piece of plastic having said pivot formed centrally thereof, and foldable about said pivot so as to form said disc shaped front end and top and bottom faces.

5. An assembly as recited in claim 4 wherein said anchor front face is two piece, having one piece integral with each of said top and bottom faces; and wherein said top and bottom faces include overlapping side edges for guiding relative movement between said top and bottom faces, and for obscuring the view of any fastener threads, for enhanced aesthetics.

6. An assembly as recited in claim 3 wherein said frame containing said channel comprises an aluminum extrusion, and wherein said fastener comprises stainless steel, said anchor comprises plastic separating all portions of said fastener from said extrusion so that said extrusion and fastener do not engage each other.

7. An assembly as recited in claim 6 wherein said fastener shank is screw threaded and wherein said disc shaped front end of said anchor comprises a circular opening for receipt of said screw threaded shank, and wherein rotation of said shank expands said anchor into tight engagement with said frame so that said anchor will not move with respect to said frame.

8. An assembly as recited in claim 7 wherein said anchor-expanding fastener head comprises a male snap fastener, for cooperation with a female snap fastener of a boat top.

9. An assembly as recited in claim 7 further comprising a driving tool engageable configuration formed centrally of said fastener head of said anchor-expanding fastener, to facilitate rotational movement of said anchor-expanding fastener with respect to said anchor.

10. An assembly as recited in claim 7 wherein said anchor includes a central opening for receiving said fastener, and wherein said central opening includes internal screw threads formed by said fastener shank being screwed therein.

11. An assembly as recited in claim 4 wherein said anchor comprises an integral piece of nylon, and wherein said pivot comprises a living hinge.

12. An assembly as recited in claim 6 further comprising a plurality of said anchors and associated said anchor-expanding fasteners spaced from each other in said channel, and in combination with a boat top having snap fasteners spaced to conform to the spacings of said anchor-expanding fasteners, said boat top fasteners engaging said anchor-expanding fasteners to releasably hold said boat top to said boat windshield frame.

13. An assembly and boat top combination as recited in claim 12 wherein said snap fasteners are substantially the only components holding said boat top onto said frame.

14. An assembly and boat top combination as recited in claim 12 wherein said anchors and associated snap fasteners are widely spaced; and wherein said boat top comprises a plastic anchoring fringe configured and dimensioned to fit within said channel and assist in holding said boat top in said channel.

15. An expanding fastener assembly comprising:

an anchor comprising an integral piece of plastic having a central pivot, and pivotal about said pivot to define top and bottom portions and a front end;

said top and bottom portions having substantially planar exterior portions that are generally quadrate in plan, and an interior face;

said front end comprising first and second elements cooperating to form a substantially disc shaped end with a central opening;

an anchor expanding fastener comprising a shank and a head, said shank dimensioned and configured to fit within said central opening to bias said top and bottom portions away from each other when said shank is received within said opening; and wherein said top and bottom portions include overlapping side edges for guiding relative movement between said top and bottom portions, and for obscuring the view of said fastener.

16. An assembly as recited in claim 15 further comprising a groove formed in each of said top and bottom portions adjacent said first and second elements, respectively, said grooves for receiving lips for positioning said anchor.

17. An assembly as recited in claim 16 wherein said shank has exterior screw threads, and wherein said interior faces of said top and bottom portions have interior screw threads formed by said shank being screwed thereinto; and wherein said fastener is metal, and wherein said head includes a driving tool-receiving configuration to facilitate rotation of said fastener by a driving tool.

18. An assembly as recited in claim 17 wherein said head comprises a snap fastener, said screw driver-receiving configuration formed centrally of said snap fastener.

19. An assembly as recited in claim 15 wherein said pivot comprises a living hinge.

20. An expanding fastener assembly comprising:

an anchor comprising an integral piece of plastic having a central pivot, and pivotal about said pivot to define top and bottom portions and a front end, said pivot comprising a living hinge;

said top and bottom portions having substantially planar exterior portions that are generally quadrate in plan, and an interior face;

said front end comprising first and second elements cooperating to form a substantially disc shaped end with a central opening; and an anchor expanding fastener comprising a shank and a head, said shank dimensioned and configured to fit within said central opening to bias said top and bottom portions away from each other when said shank is received within said opening.

* * * * *